US006390735B1

(12) United States Patent
Gaudreau et al.

(10) Patent No.: US 6,390,735 B1
(45) Date of Patent: May 21, 2002

(54) APPARATUS AND METHOD FOR A YIELDABLE TENDON MINE SUPPORT

(75) Inventors: David Gaudreau, St. Eustache; Alain Gendron, Danville; Jean-Pierre Basque, Pointe-Claire, all of (CA)

(73) Assignee: Noranda Inc., Toronto (CA)

( * ) Notice: Subject to any disclaimer, the term of this patent is extended or adjusted under 35 U.S.C. 154(b) by 18 days.

(21) Appl. No.: 09/609,246

(22) Filed: Jun. 30, 2000

(51) Int. Cl.[7] ..... E21D 20/02

(52) U.S. Cl. ..... 405/259.6; 405/259.1; 405/259.5

(58) Field of Search ..... 405/259.1, 259.2, 405/259.3, 259.4, 259.5, 259.6, 302.2; 411/387.1, 387.5, 395

(56) References Cited

U.S. PATENT DOCUMENTS

| | | | | |
|---|---|---|---|---|
| 3,602,000 A | | 8/1971 | Meheen | 61/46 |
| 3,695,045 A | | 10/1972 | Williams | 61/45 B |
| 3,967,455 A | | 7/1976 | Conway | 61/45 B |
| 4,011,787 A | | 3/1977 | White et al. | 85/76 |
| 4,055,051 A | * | 10/1977 | Finney | |
| 4,353,463 A | * | 10/1982 | Seemann | |
| 4,516,886 A | | 5/1985 | Wright | 405/261 |
| 4,564,315 A | | 1/1986 | Rozanc | 405/261 |
| 4,662,795 A | | 5/1987 | Clark et al. | 405/261 |
| 4,704,053 A | | 11/1987 | Hipkins, Sr. et al. | 405/261 |
| 4,954,018 A | | 9/1990 | Gauna | 405/259 |
| 4,984,937 A | | 1/1991 | Karpellus | 405/260 |
| 5,009,549 A | * | 4/1991 | Stankus | |
| 5,222,835 A | | 6/1993 | Wright | 405/259.6 |
| 5,233,730 A | | 8/1993 | Milne et al. | 24/136 R |
| 5,328,300 A | * | 7/1994 | Fischer et al. | |
| 5,375,946 A | | 12/1994 | Locotos | 405/259.4 |
| 5,556,233 A | | 9/1996 | Kovago | 405/259.4 |
| 5,791,823 A | | 8/1998 | Blakley et al. | 405/259.1 |
| 5,882,148 A | | 3/1999 | Mraz | 405/259.1 |
| 5,919,006 A | * | 7/1999 | Calandra, Jr. et al. | |
| 6,030,151 A | | 2/2000 | Woolnough et al. | 405/302.2 |

FOREIGN PATENT DOCUMENTS

| | | | |
|---|---|---|---|
| SE | 506 890 | 2/1998 | E21D/21/00 |
| SU | 90/4879 | 6/1990 | |
| SU | 94/2177 | 3/1994 | |

OTHER PUBLICATIONS

Jager, A.J. Two New Support Units for the Control of Rockburst Damage, Proc. Rock Support in Mining and Underground Construction, Balkema, Rotterdam (1992) pp. 621–631.*

"Two new support units for the control of rockburst damage", Proc. Rock Support In Mining And Underground Construction, Balkema, Rotterdam, pp. 621–631.

* cited by examiner

*Primary Examiner*—David Bagnell
*Assistant Examiner*—Katherine Mitchell
(74) *Attorney, Agent, or Firm*—Katten Muchin; Zavis Rosenman

(57) ABSTRACT

Apparatus, method, and a kit for a yieldable tendon mine support rock anchor include structure and/or steps including the provision of a metal support member having an outside diameter which is less than a diameter of the rock hole. Preferably, resin cartridges are disposed inside the rock hole. A wedge anchor is provided and is disposed at a distal end of the metal support member and has a narrow portion disposed uphole from a wider base portion thereof. The wedge anchor base portion is narrower than the diameter of the rock hole to permit un-solidified resin to pass from downhole to uphole of the wedge anchor base portion. The wedge anchor is dimensioned to crush solidified uphole resin and permit downhole movement of the crushed solidified resin when a yielding tension is applied to the metal support member and the wedge anchor moves uphole. A resin mixer is disposed at a distal end of the wedge anchor and preferably has a first edge for penetrating the resin cartridge and a second edge for mixing the resin.

63 Claims, 11 Drawing Sheets

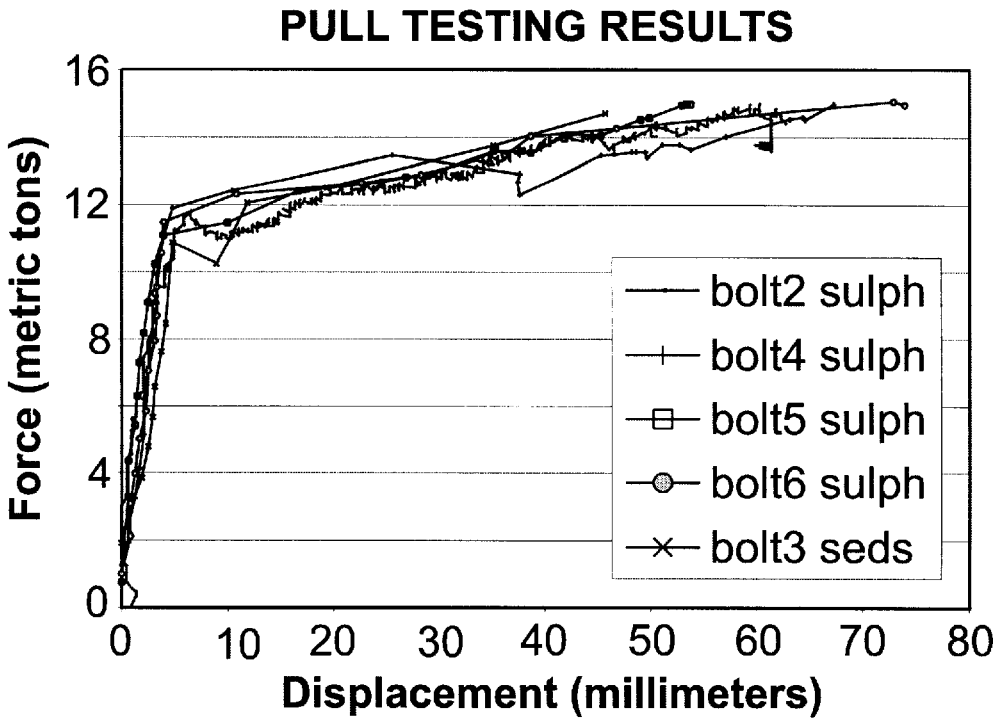
*Fig. 10 – Static pull testing results in an underground mine.*
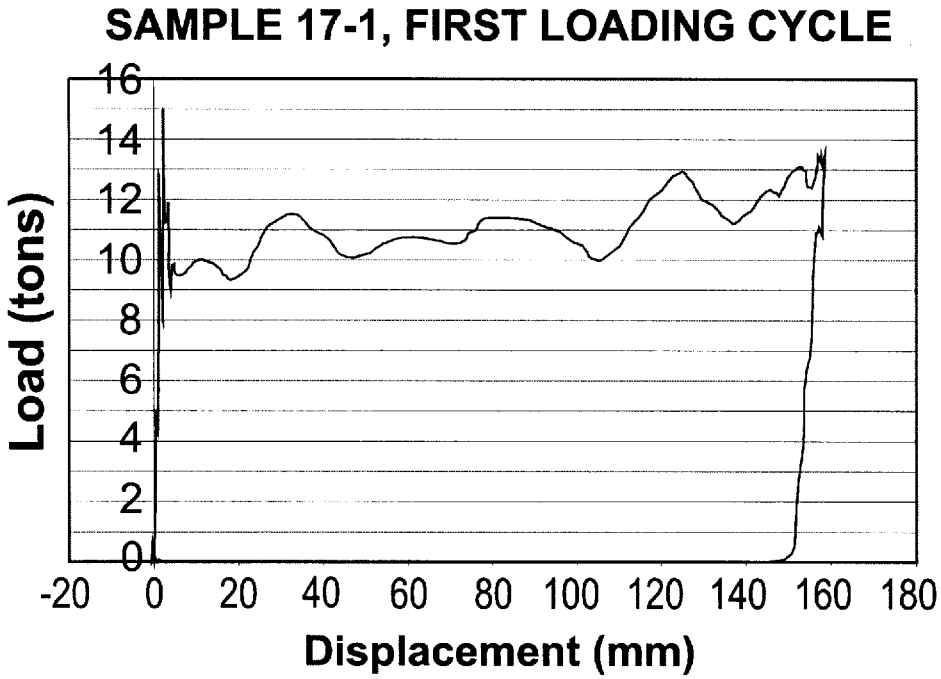
*Fig. 11– Impact loading of yielding tendon support at 17 KJ.*

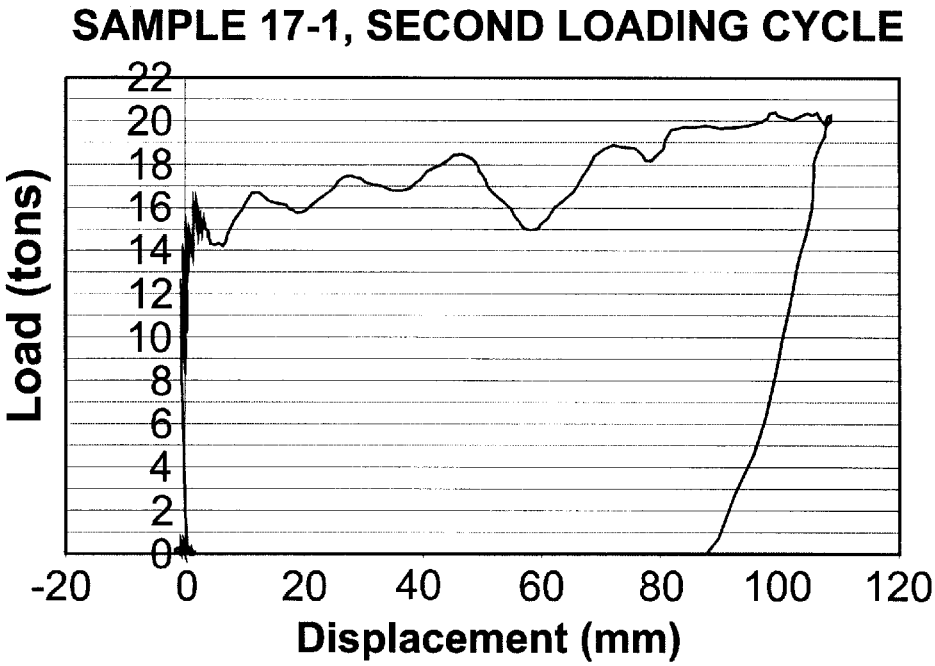
*Fig. 12 – Impact testing of yielding tendon support, second impact of 18 KJ.*
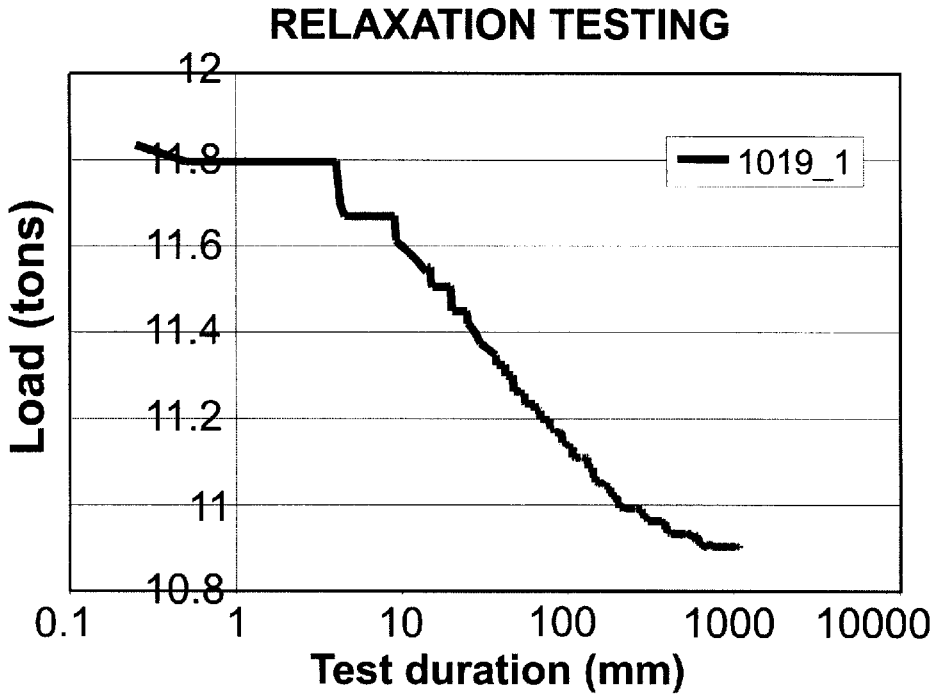
*Fig. 13 – Stress relaxation testing results*

APPARATUS AND METHOD FOR A YIELDABLE TENDON MINE SUPPORT

BACKGROUND OF THE INVENTION

1. Field of the Invention

The present invention relates to method and apparatus for the stabilization of underground excavations using steel tendons or rods, and particularly to tendons which yield rather than break under increased tension.

2. Related Art

Tunnel walls can be stabilized using supporting elements such as timber, structural steel, or rock anchors. A rock anchor is installed into a hole drilled into the rock and typically includes a stiff rod or tendon (usually made of steel), which is affixed to the rock face with a nut and a retaining plate. The rock anchor is fastened inside the rock by mechanical means in contact with the rock, or by using chemical or concrete grouts. See for example, U.S. Pat. Nos. 3,602,000; 3,695,045; 3,967,455; 4,011,787; 4,516,886; 4,564,315; 4,662,795; 4,704,053; 4,954,018; 4,984,937; 5,222,835; 5,233,730; 5,375,946; 5,556,233; 5,791,823; 5,882,148; and 6,030,151, and South African Patent Application No. 90/4879, the disclosures of each being incorporated herein by reference. To install a rock support tendon, the rock hole is first drilled and then the tendon is inserted into the hole and anchored therein using a mechanical shell, a chemical grout, or a cement-based grout.

Known chemical grouts include polyester and latex resins which can be packaged in cartridge form so that they can be inserted into the rock hole and broken and mixed therein using the tendon. When using cartridged chemical products, the product components (adhesive and catalyst) must be mixed together in the process of installing the tendon in the hole to cause the anchoring material to set. The mixing of the product components is usually performed by rotating the tendon such that the roughness or corrugations of the tendon (e.g., the striations on a rebar rod) mix the components. Special mixing devices such as helical coils may be assembled onto the tendon uphole of the anchor in order to provide better mixing quality. See for example U.S. Pat. No. 4,704,053.

However, a problem with such rock anchors is that underground tunnel walls can shift and converge when ground conditions change. Stiff rock anchors, even when subjected to small displacements, will break. It is preferable for the anchor to yield slightly while maintaining its integrity, in order to maintain support of the tunnel walls. Yielding tendons are known which are designed to have some mechanism of yield, so that the tendon cannot break as the rock around the tunnel deforms, and preferably maintains a well-defined and constant load. The yielding tendon support is used in civil mining and tunneling. The yielding tendon is a rock anchor, or a rock bolt that yields when subjected to displacement, but provides resistance to the displacement.

Known yielding tendon support designs are mostly based on frictional pulling resistance mechanisms downhole in the bore or uphole at the tendon head. For example, tendon threads may be designed to yield under stress, allowing a nut or clamp to move with respect to the tendon. Other deformable structures may be provided either downhole or at the tendon head. See for example, U.S. Pat. Nos. 3,967,455; 5,791,823; and 5,882,148. Yielding mechanisms at the tendon head offer a limited yielding displacement range, insufficient for coping with large bursts of energy, induced by mine production blasting or seismic events. Yielding mechanisms based on frictional pulling resistance can perform better in bursting ground, but are expensive and susceptible to corrosion where ground water is acidic.

COMRO introduced the Cone Bolt in 1992, a groutable tendon equipped with a cone anchor. For the Cone Bolt, energy dissipation is achieved when a wedge located downhole at the grouted end of the tendon plows through the filling material confined in the borehole, until the force on the face is no greater than the residual strength of the tendon-grout-rock hole system. The Cone Bolt can sustain slow or rapid convergence of tunnel walls. See Jager, A. J. "Two New Support Units for the Control of Rockburst Damage", Proc. Rock Support in Mining and Underground Construction, Balkema, Rotterdam (1992), pp. 621–631, and South African Patent Application No. 90/4879. The Cone Bolt was originally designed for use in cement grout. However, it is inconsistent when used with packaged resin due to its inability to mix the resin properly.

Thus, there is a need for a yielding tendon which is capable of sustaining shocks and slow or rapid convergence of tunnel walls. Depending on the selected geometry of the anchor, it can be pre-tensioned and used as active rock support.

SUMMARY OF THE INVENTION

It is an object of the present invention to provide a new yielding tendon apparatus and method which overcome the shortcomings of the prior art, and provides a reliable and strong rock anchor capable of withstanding great amounts of shock and load without catastrophic failure, thus enhancing mine safety.

According to a first aspect of the present invention, a yieldable tendon for use in a tunnel includes a rod, a conical wedge disposed at a distal end of the rod with a wider portion of the conical wedge being at a distal end thereof, and a grout mixer protruding from the distal end of the conical wedge.

According to another aspect of the present invention, a yieldable tendon for a tunnel wall hole includes a rotatable rock anchor, and a conical restraining member coupled to a distal end of the rock anchor, the conical restraining member having a cone angle of between substantially 1 degree and substantially 8 degrees with the wider dimension at a distal end of the conical restraining member. An outside diameter of a base of the conical restraining member is smaller than an inside diameter of the tunnel wall hole to permit grout to pass from a downhole portion of the conical restraining member and an uphole portion thereof. The conical restraining member is dimensioned to move through crushed solid grout when a yielding tension is applied to the rod. A grout mixer is disposed on a distal end of the conical restraining member and has a planar surface.

According to yet a further aspect of the present invention, a yieldable rock anchor comprises a metal support member having an outside diameter which is less than a diameter of a rock hole. A wedge anchor is disposed at a distal end of the metal support member and has a narrow portion disposed uphole from a wider base portion thereof. The wedge anchor base portion is narrower than the diameter of the rock hole to permit un-solidified grout to pass from downhole to uphole of the wedge anchor base portion. The wedge anchor is dimensioned to crush solidified uphole grout and permit downhole movement of the crushed solidified grout when a yielding tension is applied to the metal support member and the wedge anchor moves uphole. A grout mixer is disposed at a distal end of the wedge anchor and has a first edge for penetrating a grout cartridge and a second edge for mixing the grout.

According to yet another aspect of the present invention, a rock wall reinforcing kit includes at least one grout cartridge dimensioned to be placed downhole in a rock wall hole. A metal support member is provided and is dimensioned to fit in the rock wall hole. A wedge-shaped anchor is also provided and is coupleable to a distal end of the metal support member so that a wider portion of said wedge-shaped anchor is disposed downhole. The wedge-shaped anchor has a base end dimensioned to permit un-solidified grout from the grout cartridge to pass between sides of the rock wall hole and the anchor base to uphole of the base. The wedge shaped anchor has a wedge angle dimensioned to cause, as a yielding tension is applied to the metal support member, (i) grout uphole of said anchor base to break and move downhole of the base, and (ii) the anchor to move uphole through the grout. A grout mixer is also included and is coupleable to a distal end of the wedge-shaped anchor.

In a further aspect of the present invention, a method of installing a yieldable tendon in a rock hole comprises the steps of: (i) inserting at least one resin cartridge into a downhole portion of the rock hole; (ii) inserting a metal rod into the rock hole, the metal rod having a cone-shaped anchor affixed to a distal end thereof, with the wider base portion of the anchor disposed on the downhole side thereof, a resin mixer disposed on a downhole side of the anchor; (iii) puncturing the resin cartridge with the resin mixer; (iv) rotating the rod to cause the resin mixer to mix the resin; (v) moving the rod further downhole to cause the resin to pass the anchor base portion and move uphole thereof; and (vi) waiting until the resin uphole of the anchor base portion solidifies. Preferably, a nut and a retaining plate are then affixed to the near end of the rod to attach the anchor to the rock face.

Thus, a yielding tendon rock support according to the present invention will more readily be able to provide the following functions:

passive rock carrying effect, produced by the transfer of load through the rock mass in the zone of an originating rock arch;

active stabilizing effects, resulting in stress alteration in the neighbourhood of the mine opening and in the strain state of the rock; and energy absorbing effect, due its inherent ability to sustain impact loading by transferring part of the impact energy in the destruction of the grout material.

BRIEF DESCRIPTION OF THE DRAWINGS

The invention will now be described, by way of example, with reference to the accompanying drawings in which:

FIG. 10 is a graph depicting static pull test results for the first loading cycle of a yielding tendon in accordance with the present invention.

FIG. 11 is a graph depicting impact loading test results of a yielding tendon in accordance with the present invention.

FIG. 12 is a graph depicting impact test results of yielding tendon support for a second impact.

FIG. 13 is a graph depicting stress relaxation testing results of a yielding tendon in accordance with the present invention.

DESCRIPTION OF PRESENTLY PREFERRED EMBODIMENTS

1. Introduction

Figure 1B:
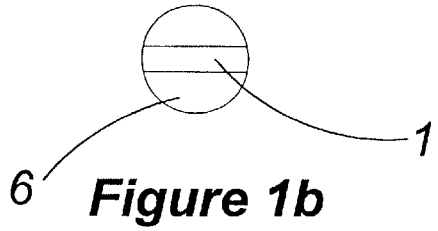
FIGS. 1A and 1B are, respectively, side and top views of a yielding tendon according to the present invention.
Figure 1A:
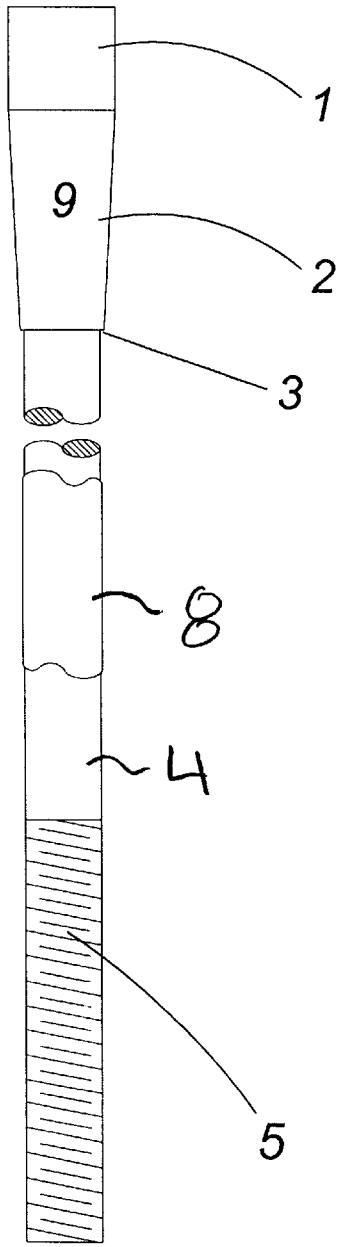
Figure 2A:
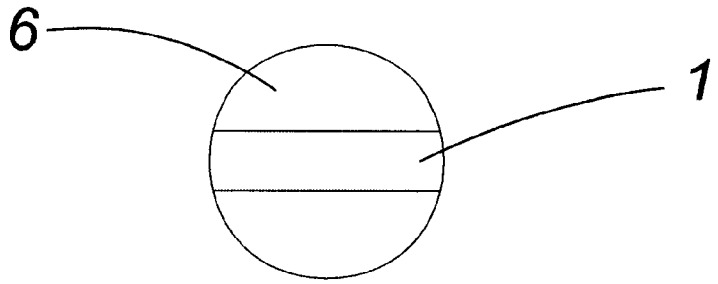
FIG. 2A is a cross-section of a portion of the yielding tendon shown in FIGS. lA and 1B.
Figure 2B:
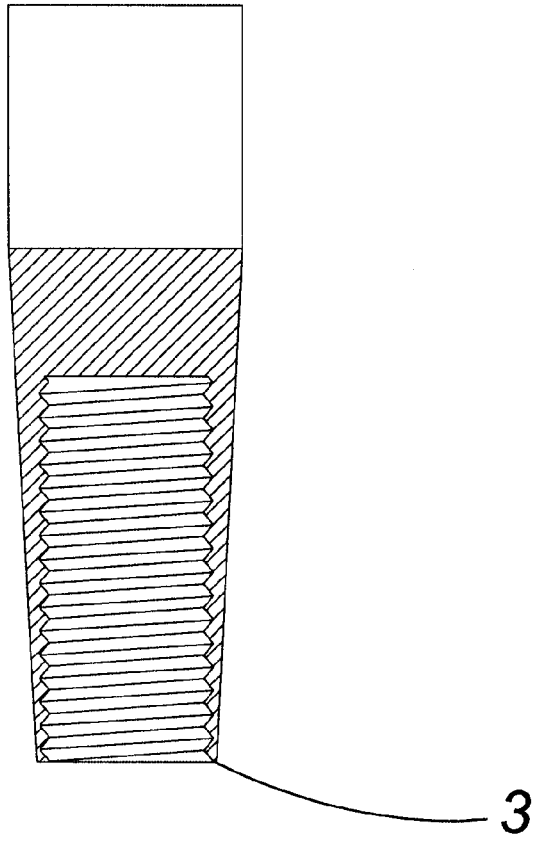
FIG. 2B is a top view thereof.

While the preferred embodiment will be described with respect to a specific example using specific dimensions and materials, the person of ordinary skill in the art will readily perceive that the relative dimensions and materials may be modified without departing from the spirit and scope of the attached claims.

Briefly, according to the preferred embodiment, a conical wedge is attached to the downhole end of the steel tendon such that the wider part of the wedge is on the downhole side. A resin mixer protrudes from the downhole end of the wedge for puncturing the resin cartridge and mixing the resin as the tendon is rotated. The conical wedge is dimensioned such that the liquid resin can flow between the sides of the hole and the edge of the wedge to uphole of the wedge. After the resin hardens, the anchor is embedded in the resin. When rock movement causes tension in the tendon, the shape and dimensions of the conical wedge are such that the wedge is allowed to gradually move uphole, crushing solid resin and moving the crushed particles downhole, past the wedge. This allows the wedge and tendon to move uphole while still being embedded in the resin, thus providing continued structural support for as long as the wedge is embedded in the resin.

There are four major features according to the preferred embodiment of the present invention to be described below:

a mixing device located on top of the tendon for proper mixing of the resin with a smooth steel bar;

an anchor shape designed to control the level of relaxation after tensioning of the bar;

an anchor shape designed to permit the tendon to yield while providing an acceptable level of resistance to the solicitation of the tendon in static and impact loading; and a method of installation using de-bonding agents to control the amount of cohesion between the surface of the tendon and the grout.

2. The Structures and Functions

Referring to FIGS. 1A, 1B, and 2A, 2B, a yielding tendon comprises a smooth steel tendon 4, a conical wedge 2, a resin mixer 1, and a shoulder 3. The steel tendon 4 is preferably a smooth bar 1.5 to 2.5 meters in length, 16 to 25 mm in diameter, and made of mild steel, more preferably, a ¾ inch (17 mm) nominal size smooth bar of steel grade 1060. In comparison, the borehole in rock is preferably 38 mm in diameter. The preferred tendon is threaded at both ends, but may comprise a threaded bar, a corrugated bar, a square cross-section bar, a hollow bar, rebar, a cable, etc. In a rock-bolting context, a tendon is any linear rock support element, but usually refers to a fully grouted cable or bolt. The tendon is characterized by an initial stiffness capable of providing a large support resistance with little deformation.

The conical wedge 2 is preferably 45 to 60 mm long (more preferably 45 to 55 mm long, even more preferably, 55 mm long), has a base 6 with a diameter of 19 to 30 mm (preferably 22 to 29 mm, and even more preferably, 25 mm), a shoulder 3 with a diameter of 17 to 21 mm (preferably 19 mm), and wherein a cone angle from the axis of the tendon is 3 degrees. The cone angle may be from substantially 1 degree to substantially 8 degrees; preferably, from substantially 2 degrees to substantially 6 degrees; more preferably, from substantially 3 degrees to substantially 5 degrees; and even more preferably, from substantially 3 degrees to substantially 4 degrees. The cone angle may vary depending upon the diameter of the borehole, the viscosity of the resin, the type of grout used, the consistency of the rock, the diameter of the tendon, etc. The conical wedge is preferably threaded onto the downhole threads of the tendon 4, but it may be welded or forged on a 17 mm diameter steel grade 1060 smooth bar or cast with a similar bar. The conical wedge may also comprise a pyramidal wedge having 3, 4, 5, 6, 7, or more sides.

The conical wedge 2 functions as an anchor in the hardened resin bed. The overall shape and dimensions of the wedge are such that it performs two important functions. First, downhole liquid resin can pass uphole between the walls of the rock hole and the base of the wedge while being mixed by passage through this restriction as the tendon is rotating. Second, the wedge can crush the solidified resin and permits movement of the broken material downhole past the anchor base. Thus, if the tendon is solicited by a load that could compromise its integrity, the crushing of the resin material dissipates part of the excess energy while maintaining a firm grip on the anchor.

The grout used with the present invention may comprise any chemical grout, concrete grout, or other grout usable in rock and earth management projects. Preferably the grout comprises two-component polyester resin cartridges, for example Fosroc LOKSET™, DuPont FASLOC™, and Ground Control GROUND-LOK™ polyester resins. These products typically come in prepackaged cartridges of varying diameters for use with various diameter rock holes.

Figure 3B:
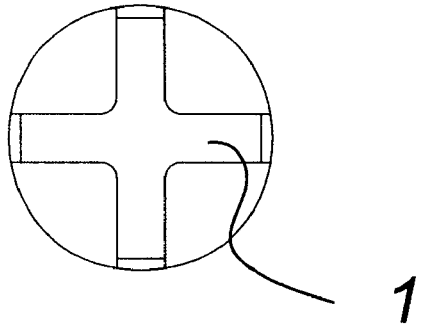
FIGS. 3A, 3B, 4A, 4B, 5A, 5B, 6A, and 6B depict cross-sectional and top plan views of alternative resin mixers according to the present invention.
Figure 3A:
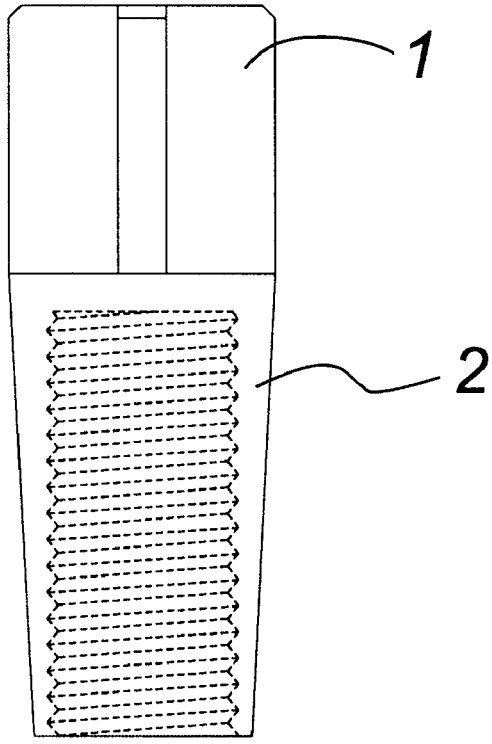
Figure 4B:
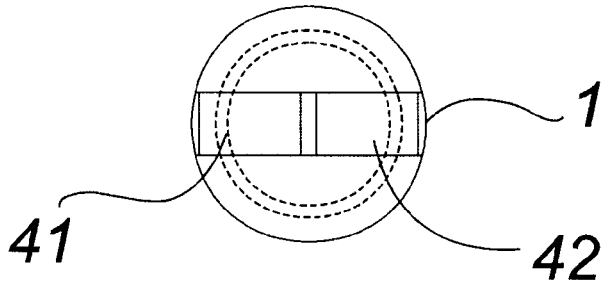
Figure 4A:
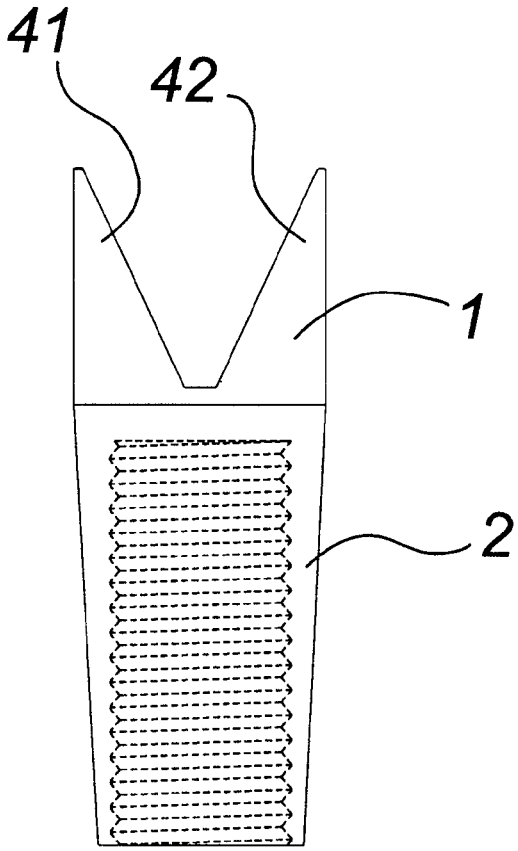

The preferred resin mixer is a flat plate 6.3 mm thick, 25.4 mm high, and 19 millimeters wide. The preferred mixer is a rectangular plate having a top edge and two side edges since this appears to provide the most thorough mixing of the resin components as the tendon is rotated. The mixer may be wider than the anchor, but the mixer should then be installed in a slot at the base of the anchor. However, various plate configurations, such as those depicted in FIGS. 3A, 3B, 4A, 4B, 5A, 5B, 6A, and 6B, may be used. In FIGS. 3A and 3B, the mixer 1 comprises two orthogonal plates having a cross-shaped cross-section. These four side edges will provide good resin mixing. In FIGS. 4A and 4B, the mixer 1 comprises two adjacent plates having oppositely protruding portions 41 and 42. Again, the side edges prove useful in efficiently mixing the resin. Also, the angle of the central v-shape may be varied to provide efficient mixing for any desired application.

Figure 5B:
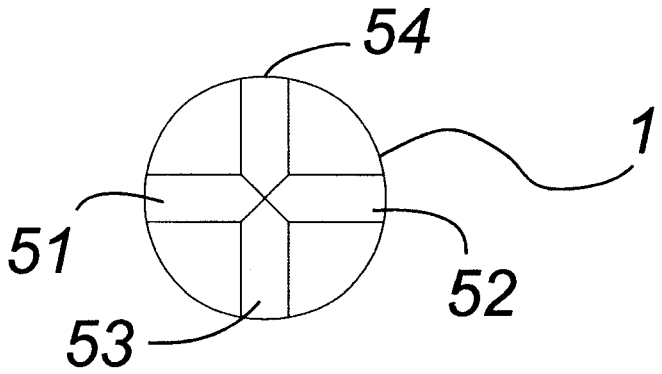
Figure 5A:
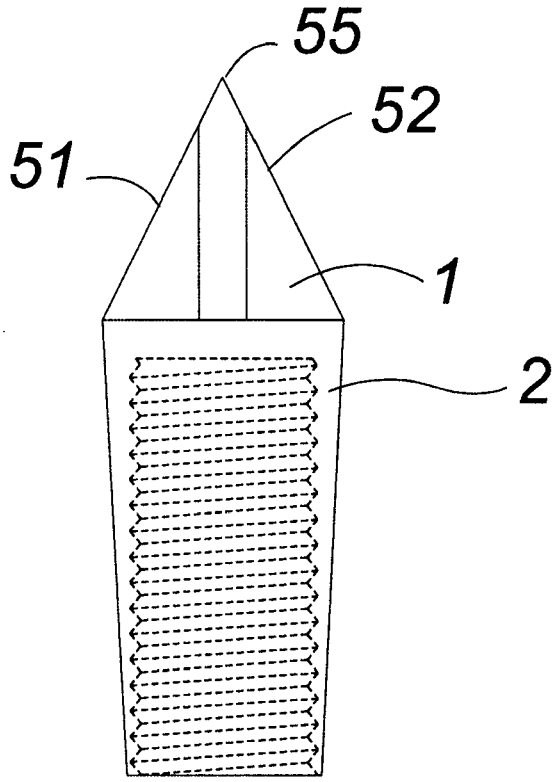
Figure 6B:
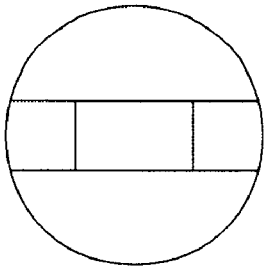
Figure 6A:
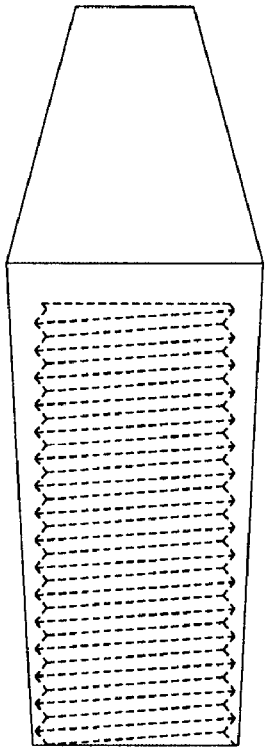

In FIGS. 5A and 5B, the mixer 1 comprises the orthogonal plate configuration of FIGS. 3A and 3B, but the plates 51, 52, 53, and 54 have outer edges that are tapered to a central point 55. This configuration provides a good point for puncturing the resin cartridges while providing four straight edges for resin mixing. In FIGS. 6A and 6B, the mixer 1 comprises a plate configuration similar to plate 6 shown in FIG. 1, but the side edges have a chiseled point which provides adequate cartridge-penetration and mixing. Persons of ordinary skill in this art can see that a wide variety configurations may be conceived to achieve the resin mixing functions according to the present invention.

The tendon 4 is preferably coated with wax 8 (typically car wax) over its whole length. The wax prevents bonding between the tendon 4 and the mixed resin 15, thus providing a smoother response of the yielding tendon support when solicited in slow or rapid loading. It also provides a limited additional corrosion resistance to the steel tendon in acid mine environments. Preferably, the wax is not applied to the conical wedge 2 or the resin mixer 1, although this may be desirable with some applications.

The nut 10 and retaining plate 11 may be standard nuts and washers typically used in rock anchors. Also, any of the hardware described in the above-listed US patents may be advantageously used with the present invention.

3. The Method

Briefly, the yielding tendon is installed in a borehole and held in place using resin grout cartridges. Those contain a catalyst and a base product. When the tendon breaks the cartridge, it releases both products and a chemical reaction solidifies the resin. Cartridges are installed in the hole, and then the tendon is pushed inside it until it reaches a distance of a minimum of 24 inches from the toe of the hole. The tendon is then spun to mix the resin and the bar is pushed simultaneously to the end of the hole. A nut or cap is used to spin the tendon at the threaded end that is outside the hole. If required, the tendon can be pre-tensioned, that is, the smooth bar can be tensioned between the anchor and a retaining plate held by the nut and supporting the tunnel wall (which includes tunnel side walls, ceilings, and floors). When the tendon is solicited by an impact induced by a seismic event, or by the deformation of the tunnel walls, there exists a differential displacement between both ends of the tendon support. The outer end of the tendon is attached to the tunnel wall. The inner end has a conical shape that can crush the solidified resin and permits movement of the broken material above the tendon. Thus, if the tendon is solicited by a load that could compromise its integrity, the crushing of the resin material dissipates part of the excess energy.

Figure 7:
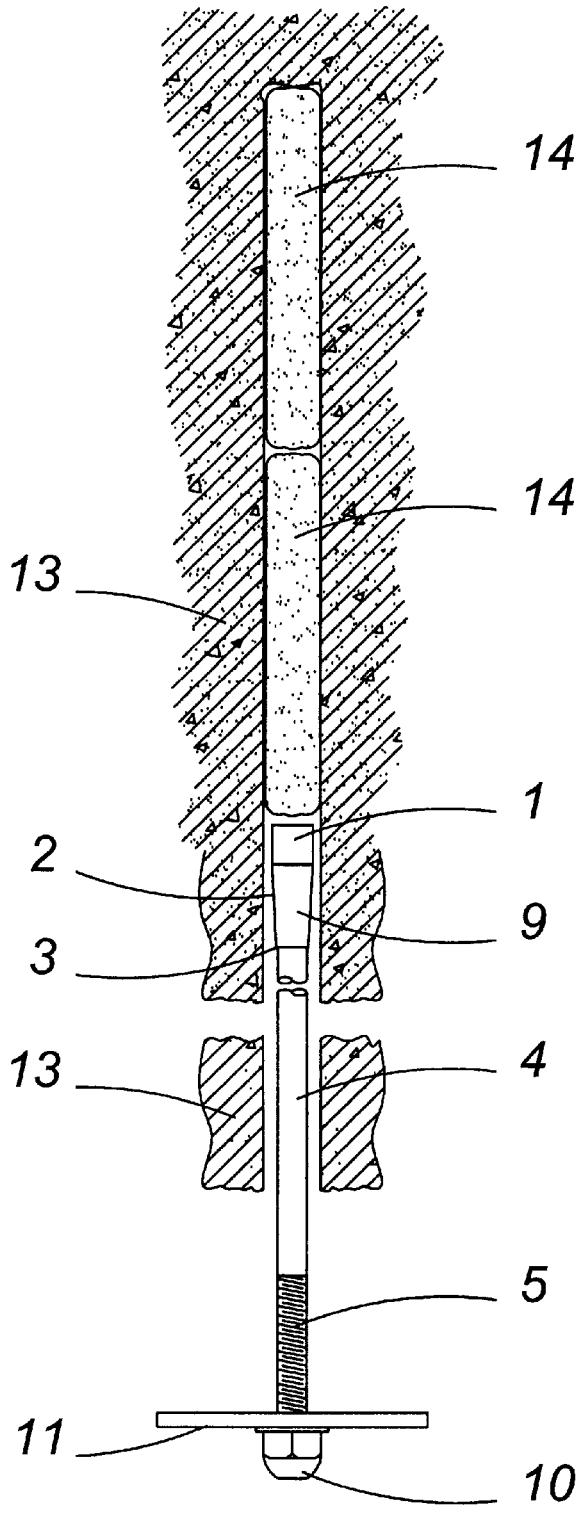
FIGS. 7, 8, and 9 depict the preferred method of installation of the yielding tendon shown in FIGS. 1A and 1B.
Figure 8:
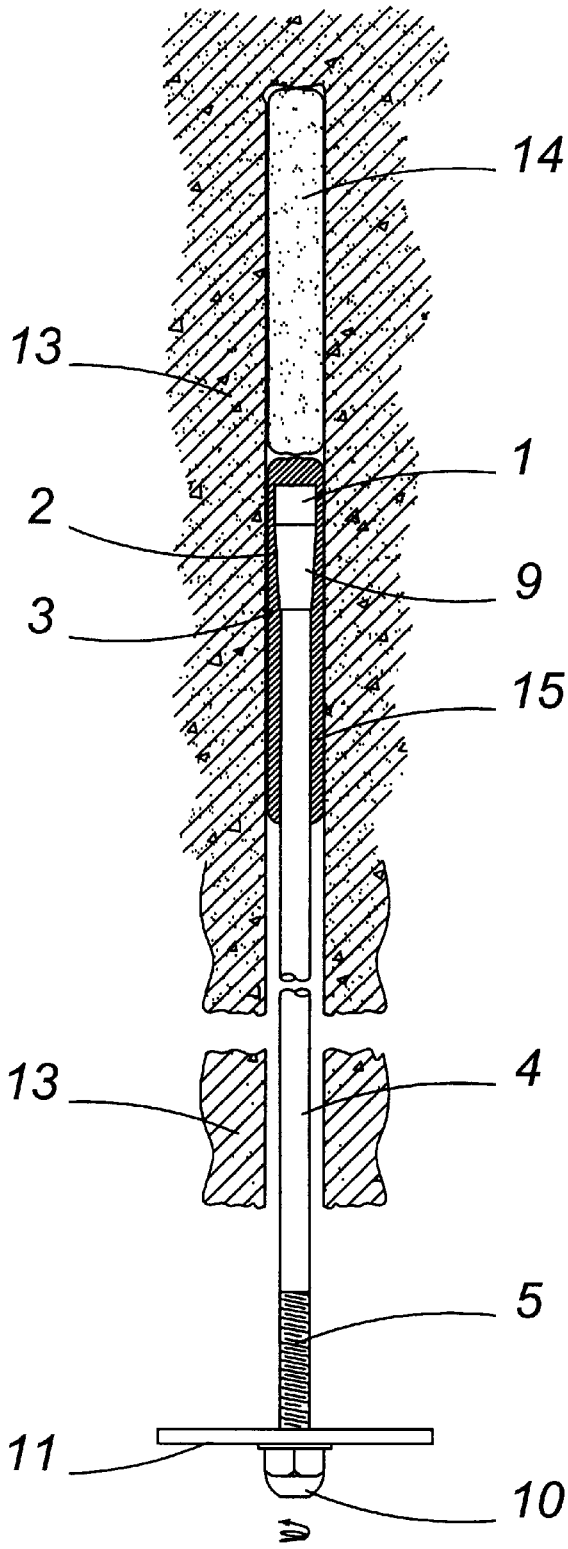
Figure 9:
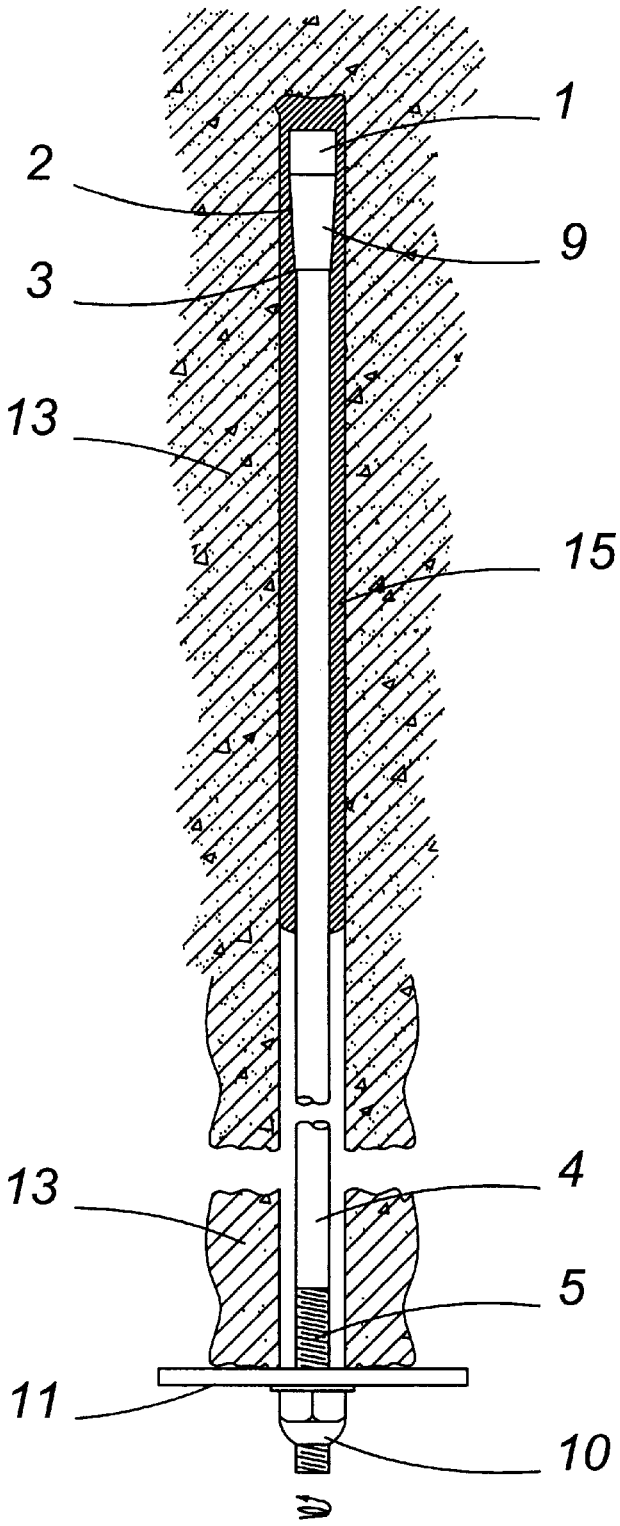

In more detail, and with reference to FIGS. 7, 8, and 9, a borehole is first drilled at the proper length in the rock 13, preferably having a 38 mm diameter, and a depth 1.5 to 2.5 meters. Cartridged resin 14 is inserted in the hole to the required bonding length, corresponding to a preferred minimum of 36 inches. The tendon 4 is pushed with a jackleg, a stoper or a mechanical rock bolter into the borehole, to a distance of a minimum of 24 inches from the targeted insertion point of the conical wedge 2, by reference to the collar of the hole. By pushing the tendon 4 into the cartridges 14, the mixer 1 punctures the cartridges 14, and the material being exposed on the top surface of the wedge anchor 6 is constricted to flow between the edge of the surface 6 and the bore hole surface, thus somewhat mixing the components of the chemical grout. The tendon is then further pushed and rotated inside the borehole using the dome nut 10, thus mixing the cartridged resin 14, until the reaction plate 11 touches the collar of the hole. If the tendon is to be pre-tensioned, the tool used for rotating and pushing the bar into the bore hole is kept in place, so that the tendon 4 will not be pushed out of the hole because of internal hole pressure (caused by the setting resin), until the fast-setting resin sets according to the manufacturers specifications. The dome nut 10 is then torqued (e.g. to 50 to 60 ft. lbs.) again in order to adjust the reaction plate 11 to the wall surface irregularities and to stretch the tendon 4 to a defined tension load between the dome nut 10 and the conical wedge 2 in the mixed resin 15.

If the yielding tendon support is installed by using a mechanical rock bolter, the tendon can be mixed over the whole length of the required resin cartridges. If the yielding tendon support is installed using a jackleg or a stoper, it becomes difficult to mix the resin over lengths of more than 1 meter from the targeted location of the conical wedge. It is then preferable to push the bar into the resin cartridges and to complete thorough mixing at the anchoring end by rotating the bar.

When pre-tensioning the disclosed tendon in grout, the consolidated material underneath the anchor could creep causing a loss of tension in the bar. This effect is controlled by the geometry of the conical wedge. The latter acts as a nail head in wood, which is confining and compressing the material underneath the anchor so that the creep will stop and a certain level of tensioning prevails in the bar.

In use, when a rock anchor is installed in a tunnel wall, for example, a yielding tension (that tension which causes the anchor to move in the resin without failing) begins at about 75% of the tensile strength of the rod (about 25,000 pounds). See FIGS. 10–13 for test results of a yielding tendon according to the preferred embodiment. The rod anchor will break at about 38,000 pounds. The tendon will typically move through the hardened resin about 4 inches before breaking. See FIGS. 10–13.

4. Test Results

Pull testing results in-situ for the preferred embodiment are illustrated in FIG. 10. For pull testing, the tendons were installed using the preferred method described below, but were not pre-tensioned. Pull testing is used to simulate static loading of the tendon through the support plate and nut. Those tests were performed in an underground tunnel using 2.2 m yielding support tendons and different resin mixtures and grouting lengths. The support was tested to 87% of its maximum capacity in a load, and provided an acceptable level of resistance to the pulling of a nut threaded at the tendon outer end.

Impact testing results for the preferred embodiment in the laboratory are illustrated in FIGS. 11 and 12. Impact testing was conducted in the laboratory by installing a 1.8 m yielding tendon using fast-setting polyester resin in a heavy gage steel tube of 38 mm internal diameter. The sample is then mounted in a drop weight-testing frame. The impact load and displacement are measured just below the reaction plate. These are mounted on the steel tendon using a threaded nut. The results show that the yielding tendon is capable of sustaining 2 impacts of more than 15 kilojoules energy without failing, and without pulling out of the testing tube by a length that would be practically too long.

Relaxation testing results (FIG. 13) in the laboratory for an embodiment of 0.9 m length and a conical wedge of 55 mm length, 4-degree cone angle from the tendon axis and 2 mm shoulder width with a mixer, show that the apparent modulus for stress relaxation tends to drop significantly after a reasonable amount of time. This makes it possible to pre-tension the tendon if necessary when installing the tendon in a borehole.

5. The Kit

Kits can be prepared for ready installation at mining locations, and preferably will comprise sufficient resin cartridges, steel tendons, conical wedges, nuts, and retaining plates to prepare and install the required rock anchors. Such kits may be prepared for each hole to be drilled, or in a mass for each tunnel to be reinforced. Persons of skill in this field may prepare appropriate kits depending upon the specific application.

6. Conclusion

Thus, what has been described are a new yielding tendon apparatus, method, and kit which provide an easy-to-install, reliable and strong rock anchor capable of withstanding great amounts of shock and load without catastrophic failure.

The individual components shown in the Drawings are all well-known in the mining arts, and their specific construction an operation are not critical to the operation or best mode for carrying out the invention.

While the present invention has been described with respect to what is presently considered to be the preferred embodiments, it is to be understood that the invention is not limited to the disclosed embodiments. To the contrary, the invention is intended to cover various modifications and equivalent arrangements included within the spirit and scope of the appended claims. The scope of the following claims is to be accorded the broadest interpretation so as to encompass all such modifications and equivalent structures and functions.

What is claimed is:

1. A yieldable tendon for a tunnel, comprising:

a rod;

a conical wedge disposed at a distal end of said rod with a wider portion of said conical wedge being at a distal end thereof; and a grout mixer protruding from the distal end of said conical wedge, said grout mixer having an overall width which is substantially equal to or less than a width of said conical wedge at its distal end, said grout mixer comprising a planar member.

2. A tendon according to claim 1, wherein said conical wedge is dimensioned so that the wedge will crush hardened grout uphole from the wedge and permit the rod to move in an uphole direction when a yield tension is applied to said rod.

3. A tendon according to claim 1, wherein said grout mixer comprises a planar surface.

4. A tendon according to claim 1, wherein said mixer comprises a rectangular member.

5. A tendon according to claim 1, wherein said rod comprises a steel rod having threads at both ends thereof.

6. A tendon according to claim 5, wherein said conical wedge is coupled to distal threads of said rod.

7. A tendon according to claim 5, wherein said conical wedge is forged to a distal end of said rod.

8. A tendon according to claim 1, wherein said conical wedge has a cone angle of between substantially 1 degree and substantially 8 degrees.

9. A tendon according to claim 8, wherein said conical wedge has a cone angle of between substantially 3 degrees and substantially 5 degrees.

10. A tendon according to claim 1, wherein said conical wedge has a base outside diameter which is smaller than an inside diameter of a hole in the tunnel.

11. A tendon according to claim 10, wherein said conical wedge base outside diameter is non-expandable.

12. A tendon according to claim 10, wherein said conical wedge base outside diameter is configured to permit grout to pass between the inside diameter of the tunnel hole and the conical wedge base outside diameter.

13. A tendon according to claim 1, wherein said rod has a wax outer coating on at least a portion thereof.

14. A tendon according to claim 1, further comprising:

a bolt coupled to a near end of said rod; and a plate disposed between said bolt and a rock face.

15. A tendon according to claim 1, wherein said grout mixer comprises one of a resin mixer and a concrete grout mixer.

16. A tendon according to claim 1, wherein said planar member intersects a longitudinal axis of the mine rock rod.

17. A mine rock anchor according to claim 1, wherein said planar member has two mixer leading edges.

18. A mine rock anchor according to claim 1, wherein said planar member comprises a single piece, rectangular plate.

19. A yieldable tendon for a tunnel wall hole, comprising:

a rotatable rock anchor;

a conical restraining member coupled to a distal end of said rock anchor, said conical restraining member having a cone angle of between substantially 1 degree and substantially 8 degrees with the wider dimension at a distal end of said conical restraining member, an outside diameter of a base of said conical restraining member being smaller than an inside diameter of the tunnel wall hole to permit grout to pass from a downhole portion of said conical restraining member and an uphole portion thereof, said conical restraining member being dimensioned to move through crushed solid grout when a yielding tension is applied to said rod; and a grout mixer disposed on a distal end of said conical restraining member, said mixer having a planar surface which intersects a longitudinal axis of said rod.

20. A tendon according to claim 19, wherein said grout mixer has an end for puncturing a grout cartridge, and two side edges for mixing the grout when said rock anchor rotates.

21. A tendon according to claim 19, wherein the grout comprises at least one of a chemical grout and a concrete grout.

22. A tendon according to claim 21, wherein the chemical grout comprises at least one of a polyester resin and a latex resin.

23. A tendon according to claim 19, wherein said conical restraining member is dimensioned to move through degraded solidified grout without gripping the tunnel wall hole.

24. A tendon according to claim 19, wherein said grout mixer comprises a rectangular, planar structure having a width substantially the same as a width of the base of said conical restraining member.

25. A tendon according to claim 19, wherein said conical restraining member has a cone angle of between substantially 3 degrees and substantially 5 degrees.

26. A tendon according to claim 19, further comprising a resin composition disposed in the tunnel wall hole uphole from the base of the conical restraining member, said resin composition permitting uphole movement of said conical restraining member without breaking said rock anchor or catastrophic failure of said resin composition.

27. A tendon according to claim 26, wherein said conical restraining member is embedded in said resin composition.

28. A tendon according to claim 19, further comprising a wax coating disposed on said rock anchor.

29. A tendon according to claim 19, wherein said conical restraining member is threaded onto the distal end of said rock anchor.

30. A tendon according to claim 19, wherein said planar member has a width which is substantially equal to or less than a width of said conical restraining member at its distal end.

31. A tendon according to claim 19, wherein said planar member has two mixer leading edges.

32. A tendon according to claim 19, wherein said planar member comprises a single piece, rectangular plate.

33. A yieldable rock anchor comprising:

a metal support member having an outside diameter which is less than a diameter of a rock hole;

a wedge anchor disposed at a distal end of said metal support member, said wedge anchor having a narrow portion disposed uphole from a wider base portion thereof, the wedge anchor base portion being narrower than the diameter of the rock hole to permit un-solidified grout to pass from downhole to uphole of the wedge anchor base portion, the wedge anchor being dimensioned to crush solidified uphole grout and permit downhole movement of the crushed solidified grout when a yielding tension is applied to said metal support member and said wedge anchor moves uphole; and a grout mixer disposed at a distal end of said wedge anchor and having a first edge for penetrating a grout cartridge and two mixing leading edges for mixing the grout, said grout mixer comprising a substantially linear, planar member.

34. A rock anchor according to claim 33, wherein said wedge anchor base portion is dimensioned to cause grout mixing as the grout moves uphole of said base portion.

35. A rock anchor according to claim 33, wherein said wedge anchor comprises a pyramidal shape.

36. A rock anchor according to claim 33, wherein said wedge anchor comprises a cone having a cone angle of between substantially 1 degree and substantially 8 degrees.

37. A rock anchor according to claim 33, wherein said mixer mixes said grout when said metal support member is rotated.

38. A rock anchor according to claim 33, wherein said mixer is welded to said wedge anchor, and wherein said wedge anchor is threaded to said metal support member.

39. A rock anchor according to claim 33, wherein said metal support member comprises a steel bar threaded at both ends.

40. A rock anchor according to claim 33, further comprising a wax coating on an outside surface of said metal support member.

41. A rock anchor according to claim 33, wherein said planar member intersects a longitudinal axis of the mine rock rod.

42. A rock anchor according to claim 33, wherein said planar member has a width which is substantially equal to or less than a width of said wedge anchor at its distal end.

43. A rock anchor according to claim 33, wherein said planar member comprises a single piece, rectangular plate.

44. A rock wall reinforcing kit, comprising:

at least one grout cartridge dimensioned to be placed downhole in a rock wall hole;

a metal support member dimensioned to fit in the rock wall hole;

a wedge-shaped anchor coupleable to a distal end of the metal support member so that a wider portion of said wedge-shaped anchor is disposed downhole, said wedge-shaped anchor having a base end dimensioned to permit grout from the grout cartridge to pass between sides of the rock wall hole and said base to uphole of said base, said wedge-shaped anchor having a wedge angle dimensioned to cause, as a yielding tension is applied to said metal support member, (i) grout uphole of said anchor base to break and move downhole of said base, and (ii) said anchor to move uphole through said grout; and a grout mixer coupleable to a distal end of said wedge-shaped anchor, said grout mixer comprising a rectilinear plate having an upper edge and two side edges, at least a portion of the grout mixer intersecting a longitudinal axis of said wedge-shaped anchor.

45. A kit according to claim 44, wherein said wedge-shaped anchor comprises a cone having a cone angle of between substantially 1 degree and substantially 8 degrees.

46. A kit according to claim 45, wherein said cone is threadable onto a threaded end of said metal support member.

47. A kit according to claim 45, wherein said metal support member comprises a steel rod threaded at both ends, and further comprising:

a nut coupleable to a near end of said rod; and a retaining plate.

48. A kit according to claim 44, wherein said grout cartridge comprises at least one of a plastic resin, a latex resin, and a concrete grout.

49. A kit according to claim 44, wherein said mixer comprises a rectangular plate welded to said anchor base.

50. A kit according to claim 44, wherein said anchor base is dimensioned to prevent surrounding contact with the sides of the rock hole.

51. A kit according to claim 44, wherein said grout mixer comprises a planar member which intersects a longitudinal axis of the metal support member.

52. A kit according to claim 44, wherein said grout mixer has a width which is substantially equal to or less than a width of said wedge-shaped anchor at its distal end.

53. A kit according to claim 44, wherein said grout mixer comprises a single piece, rectangular plate.

54. A method of installing a yieldable tendon in a rock hole, comprising the steps of:

inserting at least one resin cartridge into a downhole portion of the rock hole;

inserting a metal rod into the rock hole, the metal rod having a cone-shaped anchor affixed to a distal end thereof, with the wider base portion of the anchor disposed on the downhole side thereof, a resin mixer disposed on a downhole side of said anchor, said resin mixer having an overall width which is substantially equal to or less than an overall width of said cone-shaped anchor, said resin mixer comprising a planar member having two mixer leading edges;

puncturing the resin cartridge with the resin mixer;

rotating a rod to cause the resin mixer to mix the resin;

moving the rod further downhole to cause the resin to pass the anchor base portion and move uphole thereof; and waiting until the resin uphole of the anchor base portion solidifies.

55. A method according to claim 54, further comprising the steps of:

fixing a retaining plate and a nut to a near end of said rod before the step of rotating; and after the waiting step, rotating the nut to fix the retaining plate to outside said rock hole.

56. A method according to claim 54, wherein the step of inserting the metal rod includes the step of inserting a cone-shaped anchor having a cone angle dimensioned to permit the anchor to gradually move uphole as a yielding tension is applied to said rod.

57. A method according to claim 54, further comprising the step of pre-tensioning the rod by applying a predetermined torque to said nut after the resin has solidified.

58. A mine rock anchor, comprising:

a substantially conical wedge configured to be coupled to a distal end of a mine rock anchor rod, a wider portion of said conical wedge being disposed at a distal end of said conical wedge, said conical wedge having a cone angle of between substantially 1 degree and substantially 8 degrees; and a grout mixer protruding from the distal end of said conical wedge, said grout mixer having an overall width which is substantially equal to or less than a width of said conical wedge at its distal end, said grout mixer comprising a planar member.

59. A mine rock anchor according to claim 58, further comprising coupling structure, disposed at a proximal end of said conical wedge and configured to couple said conical wedge to the mine rock rod.

60. A mine rock anchor according to claim 59, wherein said coupling structure comprises threads.

61. A mine rock anchor according to claim 58, wherein said planar member intersects a longitudinal axis of the mine rock rod.

62. A mine rock anchor according to claim 58, wherein said planar member has two mixer leading edges.

63. A mine rock anchor according to claim 58, wherein said planar member comprises a single piece, rectangular plate.

* * * * *